United States Patent [19]

Trethewey

[11] Patent Number: 4,641,833

[45] Date of Patent: Feb. 10, 1987

[54] EXERCISE MACHINE

[75] Inventor: Reginald Trethewey, Deepwater, Australia

[73] Assignee: Comdox No. Pty. Ltd., Deepwater, Australia

[21] Appl. No.: 594,521

[22] PCT Filed: Jul. 20, 1983

[86] PCT No.: PCT/AU83/00094

§ 371 Date: Mar. 15, 1984

§ 102(e) Date: Mar. 15, 1984

[87] PCT Pub. No.: WO84/00496

PCT Pub. Date: Feb. 16, 1984

[30] Foreign Application Priority Data

| | | | |
|---|---|---|---|
| Jul. 21, 1982 | [AU] | Australia | PF4968 |
| Mar. 14, 1983 | [AU] | Australia | PF8416 |
| May 17, 1983 | [AU] | Australia | PF9390 |

[51] Int. Cl.[4] ..... A63B 69/06; A63B 21/00; A63B 21/22

[52] U.S. Cl. ..... 272/72; 272/130; 272/132

[58] Field of Search ..... 272/72, 73, 116, 117, 272/118, 120, 135, 143, 134, 93

[56] References Cited

U.S. PATENT DOCUMENTS

| | | | |
|---|---|---|---|
| 2,145,940 | 2/1939 | Marlowe | 272/72 |
| 2,278,591 | 4/1942 | Sak | 272/72 |
| 2,405,024 | 7/1946 | Eynon | 272/134 X |
| 2,642,288 | 6/1953 | Bell | 272/120 |
| 4,300,760 | 11/1981 | Bobroff | 272/120 |
| 4,300,760 | 11/1981 | Bobroff | 272/72 |

FOREIGN PATENT DOCUMENTS

| | | | |
|---|---|---|---|
| 0719167 | 10/1965 | Canada | 272/72 |

*Primary Examiner*—Robert A. Hafer
*Assistant Examiner*—Kathleen D'Arrigo
*Attorney, Agent, or Firm*—McAulay, Fields, Fisher, Goldstein & Nissen

[57] ABSTRACT

An exercise machine having a basic rowing action as well as a pushing action, in which the resistance to movement is provided by the user's body weight, and it comprises a base, a column mounted vertically on the base, a frame with a seat mounted on top of the column, an exercise bar with handles and pedals pivoted to the frame in front of the seat, and a system linking the exercise bar and the column such that rotation of the former causes elevation of the latter.

12 Claims, 3 Drawing Figures

EXERCISE MACHINE

DESCRIPTION

The exercise machine of this invention has a novel basic action which is not unlike that of a rowing machine but the resistance to movement is provided by the user's own body weight.

DETAILED DESCRIPTION OF THE PREFERRED EMBODIMENT

Figure 1:
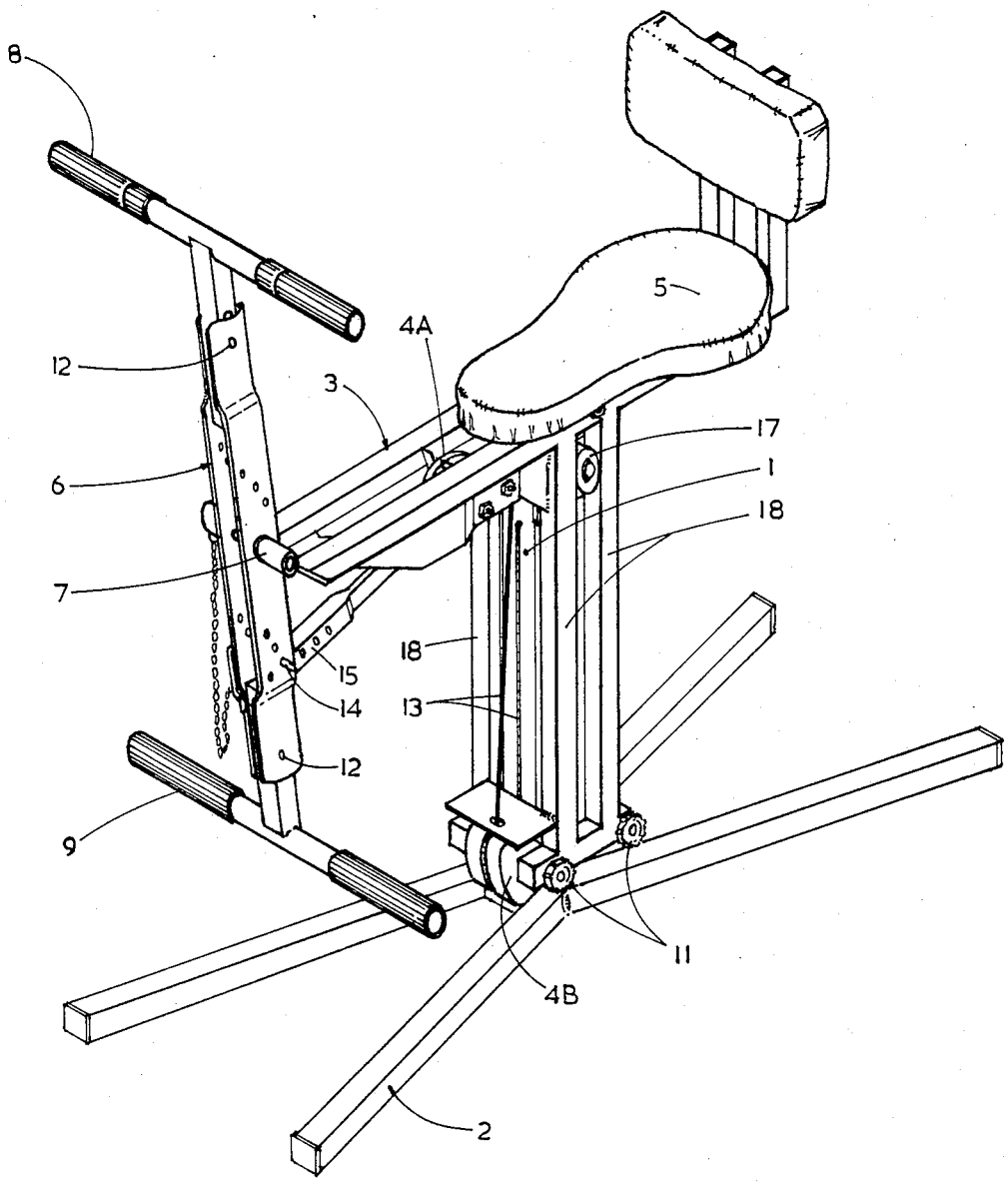
FIG. 1 is a perspective view of the exercise machine with the seat in its lowered position.

It is possible to make simple adjustments which vary the degree of leverage and resistance to movement and also to achieve a pushing action.

In one form the exercise machine of this invention comprises a base, a column mounted vertically on said base, a frame with a seat mounted on top of said column, an exercise bar with handles and pedals pivotted to said frame in front of said seat and a system linking said exercise bar and said column, such that rotation of the former causes elevation of the latter.

Following is a description of a preferred embodiment of the invention with reference to the accompanying drawing. A column 1 is mounted on a base 2. A horizontal frame 3 is supported by column 1 and carries a seat 5.

In front of the seat 5 an exercise bar 6 is pivotted on the frame 3 at 7. The upper end of bar 6 carries a handle bar 8 and at the lower end pedals 9. The handle and pedal assemblies can be extended in a longitudinal direction by variable adjustment at 12.

One end of a cable 13 is anchored to the column 1 under the front of the seat 5 and the other end 16 is pivotted to the bar 6 at 14. The cable 13 runs on pulley wheels 4A and 4B.

Figure 2:
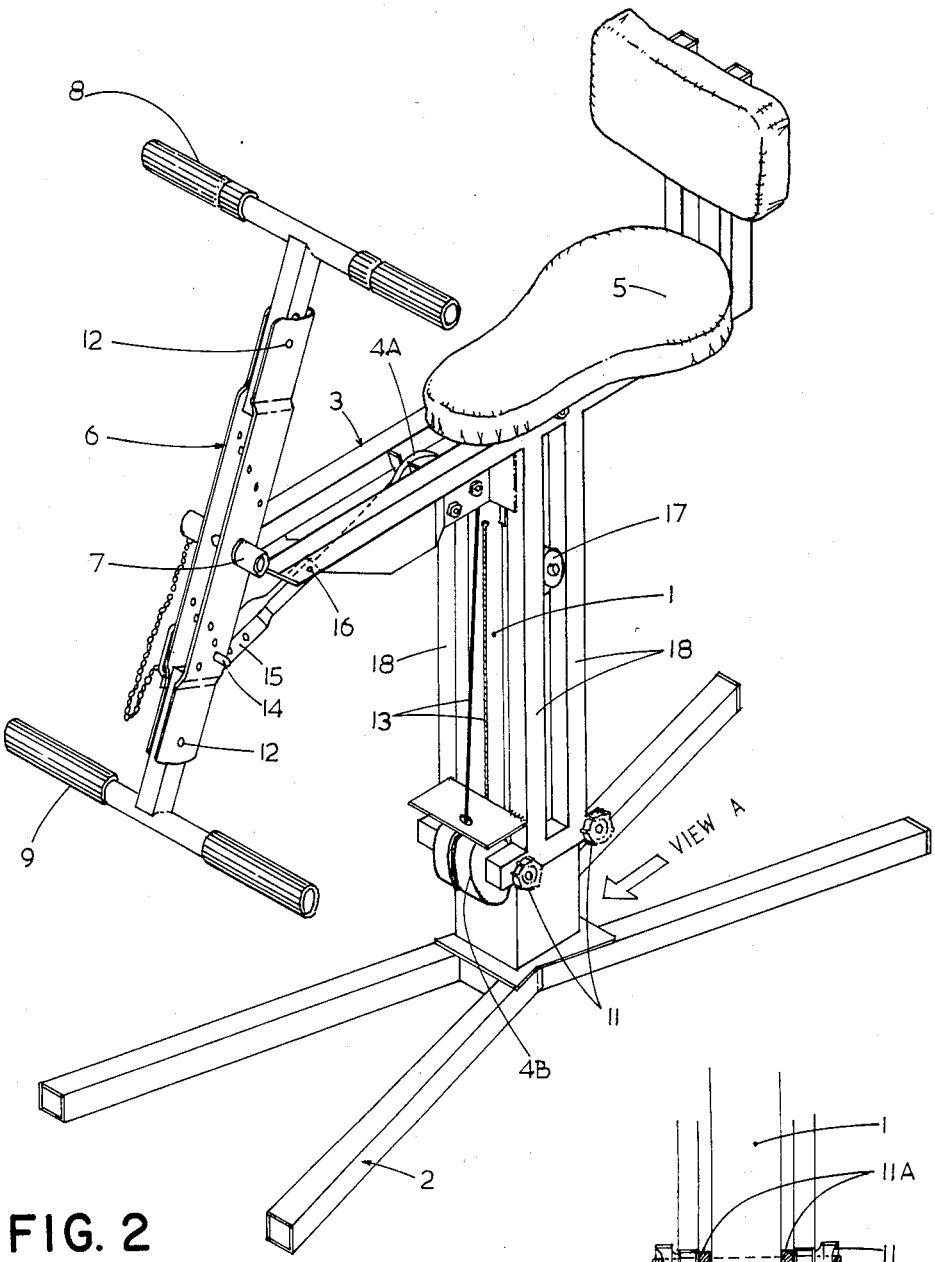
FIG. 2 is another perspective view of the exercise machine of FIG. 1 with the seat raised from its lowered position.
Figure 3:
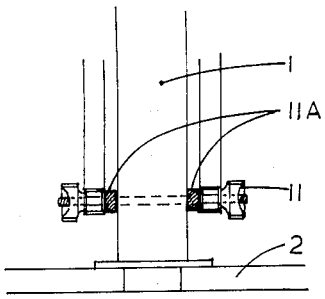
FIG. 3 is a side view, partially in section of a portion of FIG. 2 looking in the direction of the arrow designated VIEW A in FIG. 2, showing a detail of the friction pads.

FIG. 2 shows that when exercise bar 6 rotates in a clockwise direction, frame 3 moves upwards with runners 18, which are part of frame 3, guided by wheels 17 which are fixed to column 1.

This relative movement takes place because the part of cable 13 between pulleys 4A and 4B is shortened as it is drawn over the pulleys by exercise bar 6.

Relative translation between the frame 3 and the base 2 is prevented by wheels 17 which are restrained in a vertical line by the runners 18.

The runners 18 are movable with respect to base 2. Seat 5 is carried by frame 3. Spaced pulleys 4A and 4B are rotatably coupled to frame 3 and runners 18, respectively. Cable 13 has one end anchored to column 1 and the other end 16 connected with bar or pivot member 15 which is partially mounted to exercise bar 6 such that the other end 16 is pivotally operatively anchored to the excercise bar 6. The cable 13 runs on pulleys 4A and 4B and because part of the cable is shortened as it is drawn over the pulleys 4A and 4B seat 5 is raised as exercise bar 6 rotates in a clockwise direction. Cable 13 is connected to exercise bar 6 through the intermediation of bar or pivot member 15.

The bar or pivot member 15 provides an adjustable pivot connection to exercise bar 6 such that the exercise machine is operative alternately with a user pulling the exercise bar with the user's arms and pushing the exercise bar with the user's feet or with the user pushing the exercise bar with the user's arms and pulling or drawing the pedals 9 of the exercise bar with the user's feet.

The rowing action is achieved in the following way. The user sits on the seat 5 with hands gripping the handle bar 8 and feet placed on the pedals 9.

The user pulls with his arms and pushes with his feed thus rotating the exercise bar 6. The cable 13 runs over the pulley wheels 4A and 4B thereby raising the frame 3. At the end of the stroke the user's body weight causes the frame to lower to its original position, the downward motion slowed by friction pads 11A bearing on central column 1.

The above and other variations are possible without departing from the basic inventive concept, which is to provide an exercise machine which allows a rowing and a pushing action and in which the resistance to movement is provided by the user's own body weight.

The claims defining the invention are as follows:

1. An exercise machine comprising:

a base supporting a movable frame having a seat thereon;

an exercise bar with handles and pedals supported on said frame;

a linkage system connecting said bar to said frame such that rotation of said bar causes elevation of said frame;

a column mounted on said base, runners operatively associated with said column and connected with said frame, said runners being movable towards and away from said base;

a pair of spaced pulleys rotatably coupled to said runners; and a cable having one end operatively anchored to said column and another end pivotally operatively anchored to said exercise bar and running on said pulleys for moving said runners to raise said seat.

2. The exercise machine of claim 1, including adjustable friction pads for imparting resistance to the motion of the frame.

3. The exercise machine of claim 1, wherein said linkage system includes a single pivot pivotally connecting said frame to said bar.

4. The exercise machine of claim 1, including a variable adjustment for adjustment of said handles and said pedals longitudinally of said exercise bar.

5. The exercise machine of claim 1, wherein said another end of said cable includes an adjustable pivot connection to said exercise bar so that said exercise machine is operative alternatively with the user pulling said exercise bar with the user's arms and pushes with the user's feet or with the user pushing said exercise bar with the user's arms and pulling or drawing said pedals of said exercise bar with the user's feet.

6. The exercise machine of claim 5, wherein said exercise bar and said frame are interrupted by a single pivot so that said pedals and said handle pivot together as a unit on said exercise bar about said frame.

7. An exercise machine comprising:

a base;

a column mounted vertically on said base;

a frame including runners with a seat mounted on top of said frame;

an exercise bar with handles and pedals pivoted to said frame in front of said seat;

a cable linkage between said bar and said column and said frame such that rotation of the bar causes elevation of said frame;

said runners being movable and operatively associated with said column, said movable runners having one end carrying said seat and another end movable towards and away from said base;

a pair of spaced pulleys rotatably coupled to said runners; and said cable linkage including a cable having one end operatively anchored to said exercise bar and running on said pulleys for moving said runners to raise said seat.

8. The exercise machine of claim 7, wherein said another end of said cable includes an adjustable pivot connection to said exercise bar so that said exercise machine is operative alternatively with the user pulling said exercise bar with the user's arms and pushes with the user's feet or with the user pushing said exercise bar with the user's arms and pulling or drawing said pedals of said exercise bar with the user's feet.

9. The exercise machine of claim 7, wherein said exercise bar and said frame are interrupted by a single pivot so that said pedals and said handle pivot together as a unit on said exercise bar about said frame.

10. The exercise machine of claim 7, including a variable adjustment for adjustment of said handles and said pedals longitudinally of said exercise bar.

11. The exercise machine of claim 7, including adjustable friction pads for imparting resistance to the motion of said movable frame.

12. An exercise machine comprising:

a base;

a column mounted vertically on said base;

a frame including runners with a seat mounted on top of said frame;

an exercise bar with handles and pedals pivoted to said frame in front of said seat;

a cable linkage between said bar and said column and said frame such that rotation of the bar causes elevation of said frame;

said runners being movable and operatively associated with said column, said movable runners having one end carrying said seat and another end movable towards and away from said base;

a pair of spaced pulleys rotatably coupled to said runners, said cable linkage including a cable having one end operatively anchored to said column and another end operatively anchored to said exercise bar and running on said pulleys for moving said runners to raise said seat against a user's own body weight;

a single pivot pivotally connecting said frame to said exercise bar for pivoting said handles and said pedals together as a unit about said single pivot in front of said seat;

a variable adjuster for adjustment of said handles and said pedals longitudinally of said exercise bar and transversely to said frame; and said one end of said cable being mounted to said column under said seat such that rotation of said exercise bar causes elevation of said runners.

* * * * *